United States Patent [19]

Bugnone

[11] 4,132,166

[45] Jan. 2, 1979

[54] MOUNTING FOR ROTARY CYLINDERS, PARTICULARLY IN A PRINTING PRESS

[76] Inventor: Aldo Bugnone, Via Bellini 2, Turin, Italy

[21] Appl. No.: 840,450

[22] Filed: Oct. 7, 1977

[30] Foreign Application Priority Data

Oct. 20, 1976 [IT] Italy ..... 69528 A/76

[51] Int. Cl.[2] ..... B41F 13/26; B41F 13/38

[52] U.S. Cl. ..... 101/247; 101/153; 118/258

[58] Field of Search ..... 101/247, 216, 219, 152, 101/153, 154, 136, 141, 182, 185; 100/168, 169; 118/4, 258; 83/679

[56] References Cited

U.S. PATENT DOCUMENTS

| | | | |
|---|---|---|---|
| 2,212,820 | 8/1940 | Barber | 101/153 |
| 2,607,292 | 8/1952 | Harless et al. | 101/153 |
| 2,821,913 | 2/1958 | Johnson | 101/178 |
| 2,900,951 | 8/1959 | Kabelitz | 101/247 X |
| 3,131,631 | 5/1964 | Haskin, Jr. | 101/152 |

FOREIGN PATENT DOCUMENTS

| | | | |
|---|---|---|---|
| 1282026 | 11/1968 | Fed. Rep. of Germany | 101/247 |

*Primary Examiner*—J. Reed Fisher

*Attorney, Agent, or Firm*—Sughrue, Rothwell, Mion, Zinn and Macpeak

[57] ABSTRACT

A mounting for supporting a pair of cylinders, particularly for use in printing machines, in which the cylinders are adjustably arranged and kept at a given distance from each other, wherein a first cylinder of the pair of cylinders is supported at each end thereof by a resiliently deformable member, and that the second cylinder of the pair of cylinders is movable towards, and away from, the first cylinder by means of an adjusting support device which, in operation, is responsive to resilient deformations of the resiliently deformable member when such deformations exceed a predetermined value.

2 Claims, 2 Drawing Figures

MOUNTING FOR ROTARY CYLINDERS, PARTICULARLY IN A PRINTING PRESS

The present invention relates to a mounting for a pair of rotary cylinders, particularly for use in printing machines, in which the cylinders are adjustably arranged and kept at a given distance from each other.

BACKGROUND OF THE INVENTION

Conventional printing machines have a plate cylinder mounted for rotation in bearings fixed in a frame while an impression cylinder is adjustably mounted at a predetermined distance from the plate cylinder, or the impression cylinder is held in a fixed position on the frame whereas the plate cylinder is arranged at an adjustable distance from the impression cylinder. With the known machines, it is often difficult to exactly adjust the distance between the impression and plate cylinders, and thus to control the pressure applied, for example, to a sheet of paper to be printed passing between the pair of cylinders. A major difficulty arises in measuring and controlling the pressure to be applied to the sheet material to be printed, this being especially true when one of the cylinders or both are not exactly cylindrical in shape and well centered due to wear after extensive use.

An object of this invention is to provide a mounting designed to support a pair of cylinders, which mounting makes it possible to obtain a desired pressure applied to a sheet material passing between the cylinders, and to adjustably control such pressure during the operation of a machine in which the mounting is utilized.

Another object of this invention is to provide a mounting in which the pressure exerted by the pair of cylinders is constantly measured and monitored.

Another object of this invention is to provide a mounting of high performance and accuracy, unexpensive to manufacture and reliable in operation.

SUMMARY OF THE INVENTION

These objects are attained, according to the invention, by a mounting comprising a support frame, at least two resiliently deformable members arranged opposite to each other and fixed to the said frame, a first cylinder mounted for rotation in the said resiliently deformable members, a second rotatable cylinder arranged parallel to the first cylinder and movable towards, and away from, the first cylinder, adjusting support means mounted in the said frame and designed to adjustably support the second cylinder, and control means responsive to resilient deformations of the said deformable members and arranged to control the said adjusting support means when the resilient deformations exceed, a predetermined level.

BRIEF DESCRIPTION OF THE DRAWINGS

A preferred embodiment is described below with reference to the accompanying drawings, in which.

DETAILED DESCRIPTION OF THE INVENTION

Figure 1:
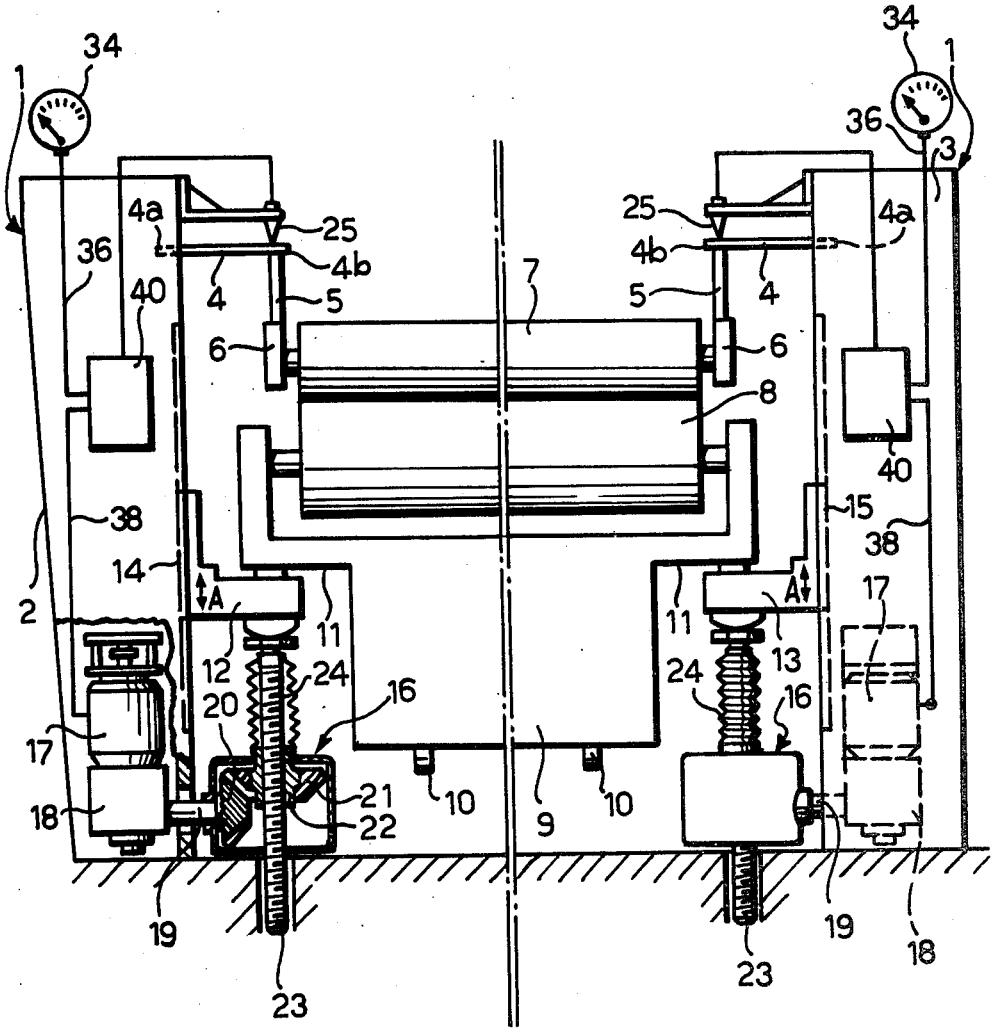
FIG. 1 is a diagrammatic front view of a mounting according to the invention.

FIG. 1 shows a mounting which comprises a fixed frame 1 having two uprights 2 and 3 arranged opposite to and spaced from, each other. Each upright 2, 3 carries at its upper part a resiliently deformable cantilever beam 4 which has one end 4*a* fixed in a respective upright.

The free end 4*b* of each beam 4 carries, either directly or by means of an intermediate member or members 5, a bearing 6 which rotatably supports the respective end of a first cylinder 7. In the illustrated embodiment, the cylinder 7 is, for example, an impression cylinder of a printing press.

The cylinder 7 cooperates with a second cylinder 8 which is arranged beneath and parallel to the cylinder 7 and is a plate cylinder in the example shown. The plate cylinder 8 is rotatably supported by a carriage 9 having wheels 10 for transporting the plate cylinder 8 to, and away from, the printing press. The carriage 9 comprises a pair of shoulders 11 which are engaged and lifted towards the cylinder 7 by means of respective slides 12, 13 which are vertically displaceable in the direction of the double arrow A along guides 14, 15 formed in the uprights 2 and 3.

Each slide 12, 13 is controlled and displaced by an adjustable support device 16 which comprises a reversing motor 17, a speed variator 18, a transmission shaft 19, level gears 20, 21, and a screw and nut arrangement 22, 23, comprising a vertical lifting screw 23. Preferably or optionally the device 16 may comprise two motors one of which is a high-speed motor to be used for rapid lifting (or lowering) of the cylinder 8 up to a level at which the cylinder 8 is close to the cylinder 7, and the other is a low-speed motor to be used for fine adjustement movements of the cylinder 8 towards, and away from, the cylinder 7. Each of the slides 12, 13 bears on the upper end of the respective screw 23.

As shown in the drawings, each of the screws 23 is advantageously protected by a bellows 24.

Moreower, the cylinder 8 has coupling means (not shown) for connection to a drive from a printing machine.

Figure 2:
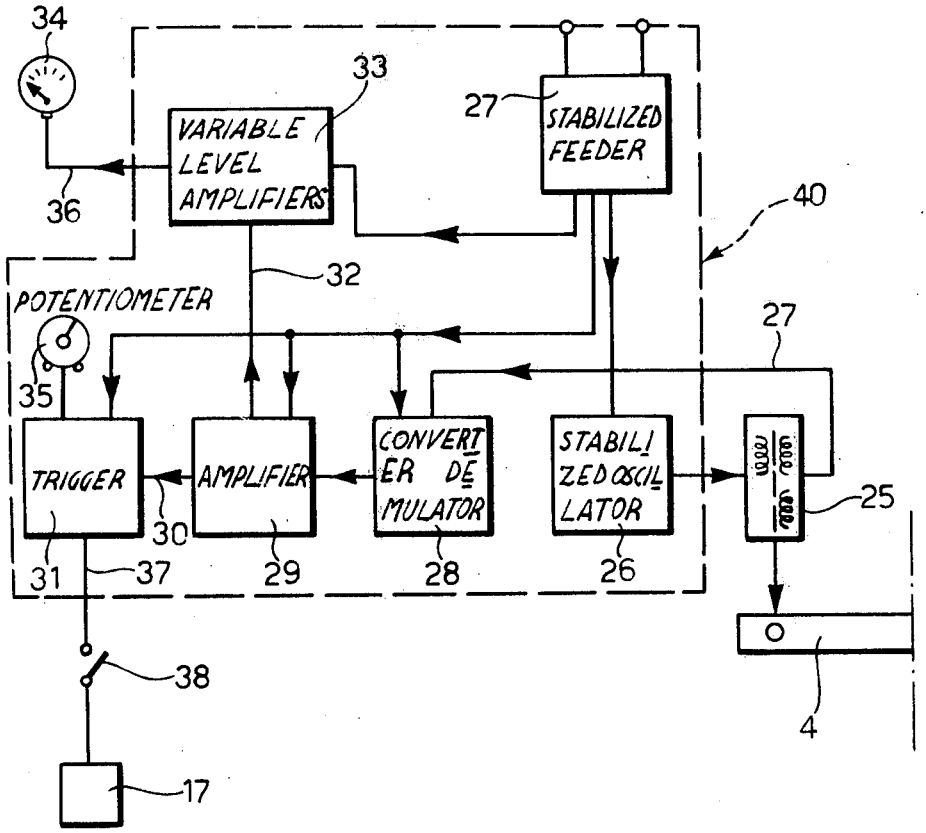
FIG. 2 is a block diagram of a control circuit of the mounting.

With each cantilever beam 4 is associated a sensor 25 supported by the respective upright, designed to detect resilient up and down deflections of the beam 4. Each sensor 25 (FIG.2) comprises an electric transducer whose input is connected to the output of a stabilized oscillator 26. The oscillator 26 is connected to one of the outputs of a stabilized power supply unit 27 which is, in turn, connected to the mains.

The transducer 25 transforms the deflections of the beam 4 into frequency-modulated signals which are forwarded by way of the cable 27 to a converter-demodulator 28 which converts its input signals into voltage-modulated output signals which are amplified by an amplifier 29. The amplifier 29 has two outputs, one of which is connected by a cable 30 to an input of a trigger 31, and the other output is connected by a cable 32 to a unit 33 comprising variable-level amplifiers which control an indicator or monitor unit 34 through a cable 36.

The trigger 31 is pre-set at a given threshold value by means of a potentiometer 35. Should such a pre-set threshold value be exceed, the trigger 31 energized via a lead 37 a relay 38 which then opens the control circuit (not shown) of the respective motor 17. The circuit unit including the supply 27, the oscillator 26, the demodulator 28, the amplifier 29, the trigger 31, and the amplifiers 33 is housed in a box 40 (FIG. 1).

With the above described arrangement, the cylinder 8 can be moved towards and away from the cylinder 7 and the cylinders 7 and 8 can be brought to a given distance from each other so as to apply a required pressure to a sheet material passing between the cylinders.

The motors 17 are manually controlled when the carriage 9, and thus the cylinder 8, is either to be removed from the machine or to be placed in it. While the cylinder 8 is being lifted by motors 17 towards the cylinder 7 it will reach a level at which it applies an upward force to cylinder 7. This result in a resilient deformation of the cantilever beams 4 which is detected by the sensors 25 and as soon as the threshold value pre-set in the trigger 31 is reached the relay 38 is energized and the respective motor 17 is stopped.

Advantageously, the pressure or the distance between the cylinders 7 and 8 can be read on the two indicators 34 which assist the attendant of the printing machine in adjusting and setting the relative position of the two cylinders.

It is to be understood that the mounting according to the invention may be used not only in printing machines but also in coating machines, painting machines or machines for embossing, cutting or punching sheet, tape or strip materials.

I claim:

1. A mounting arrangement for rotatable cylinders comprising a support frame, at least two resiliently deformable beam members arranged opposite to each other and fixed to said frame, a first cylinder mounted for rotation in said resiliently deformable beam members, support means mounted in said frame for movement toward and away from said first cylinder, a second cylinder rotatably mounted in said support means parallel to said first cylinder and adapted to contact said first cylinder upon movement of said support means towards said first cylinder, reversible drive means for moving said support means and said second cylinder toward and away from said first cylinder, sensor means mounted on said frame and disposed in contact with said beam members for providing a signal responsive to the deformation of said beam members, and circuit means including said sensor means and said drive means responsive to the signal provided by said sensor means to stop said drive means when the pressure exerted by said second cylinder on said first cylinder causes a predetermined deformation of said beam members.

2. A mounting arrangement as set forth in claim 1, wherein said support means includes a pair of spaced apart slides displaceable in said frame and said drive means includes a nut and screw arrangement engagable with each slide and an electric motor operatively connected to each nut and screw arrangement.

* * * * *